United States Patent [19]

Shiga

[11] Patent Number: 4,726,330

[45] Date of Patent: Feb. 23, 1988

[54] FUEL MIXING AND SUPPLYING APPARATUS FOR INTERNAL COMBUSTION ENGINES

[75] Inventor: Mitsuo Shiga, Saitama, Japan

[73] Assignee: Honda Giken Kogyo Kabushiki Kaisha, Tokyo, Japan

[21] Appl. No.: 923,370

[22] Filed: Oct. 27, 1986

[30] Foreign Application Priority Data

Oct. 28, 1985 [JP] Japan ..... 60-240780

[51] Int. Cl.[4] ..... F02B 33/04

[52] U.S. Cl. ..... 123/73 AD

[58] Field of Search ..... 123/73 AD, 73 R, 196 R

[56] References Cited

U.S. PATENT DOCUMENTS 3,886,914 6/1975 Ahrns et al. ..... 123/73 AD
4,121,631 10/1978 Jones ..... 123/73 AD
4,388,896 6/1983 Sheridan et al. ..... 123/73 AD
4,471,728 9/1984 Borst et al. ..... 123/73 AD
4,480,602 11/1984 Kobayashi et al. ..... 123/73 AD
4,638,771 1/1987 Mori ..... 123/73 AD

*Primary Examiner*—Craig R. Feinberg
*Assistant Examiner*—David A. Okonsky
*Attorney, Agent, or Firm*—Lyon & Lyon

[57] ABSTRACT

A fuel and lubricating oil mixing system designed primarily for two-cycle engines. Lubricating oil and fuel are stored in separate containers and mixed prior to entering the carburetor. Fuel flow is monitored by flow detector which relays information to a control unit. This unit in turn controls valves and pumps, mounted on both lubricating oil and fuel lines, in order to maintain a preferred mixture ratio regardless of engine speed or fuel flow rate. Such control ratio makes possible maximum convenience and performance with minimum engine wear.

6 Claims, 4 Drawing Figures

FUEL MIXING AND SUPPLYING APPARATUS FOR INTERNAL COMBUSTION ENGINES

BACKGROUND OF THE INVENTION

The field of the present invention is fuel mixing systems wherein proportionate amounts of lubricating oil and fuel are mixed and supplied to an internal combustion engine, typically a two-cycle engine.

Two-cycle engines generally require that lubricating oil be fed to them during running. Such has been accomplished in the past by placing a predetermined amount of oil into the fuel tank to obtain the required ratio, or through a separate oil reservoir which supplies oil to the combustion chamber through an intake manifold or mixing at the carburetor.

In the first system, it proves troublesome to mix fuel and oil in advance and further devices are required to make appropriate measurements and perform the mixing. Yet it still remains difficult to ensure a correct ratio.

In the second system, the amount of lubricating oil supplied depends upon the rotation of the engine and opening angle of the throttle; thus the actual fuel flow rate is not accounted for and a constant mixture ratio cannot be maintained. In absence of a constant ratio, either too much exhaust smoke may be produced due to overburning of oil or not enough oil may enter to properly lubricate the engine, resulting in premature wear.

Finally, any separate fuel and oil mixing system generally must surmount the problem of inaccurate mixing due to the small amounts of oil mixed at any one time. Thus, amounts mixed each time must be large enough to ensure a stable mixing ratio.

SUMMARY OF THE INVENTION

The present invention is directed to a system wherein fuel and lubricating oil are stored in separate tanks and are mixed just before reaching the carburetor in a predetermined ratio. To this end, a signal based upon the flow of fuel is utilized to achieve the appropriate mixture.

Accordingly, it is an object of the present invention to provide an apparatus to mix and supply fuel and oil to an internal combustion engine in a predetermined ratio which is formed before the mixture enters the carburetor, thereby stabilizing the consumption of lubricating oil and the amount of exhaust smoke produced. Other and further objects and advantages will appear hereinafter.

DETAILED DESCRIPTION OF THE PREFERRED EMBODIMENTS

Figure 1:
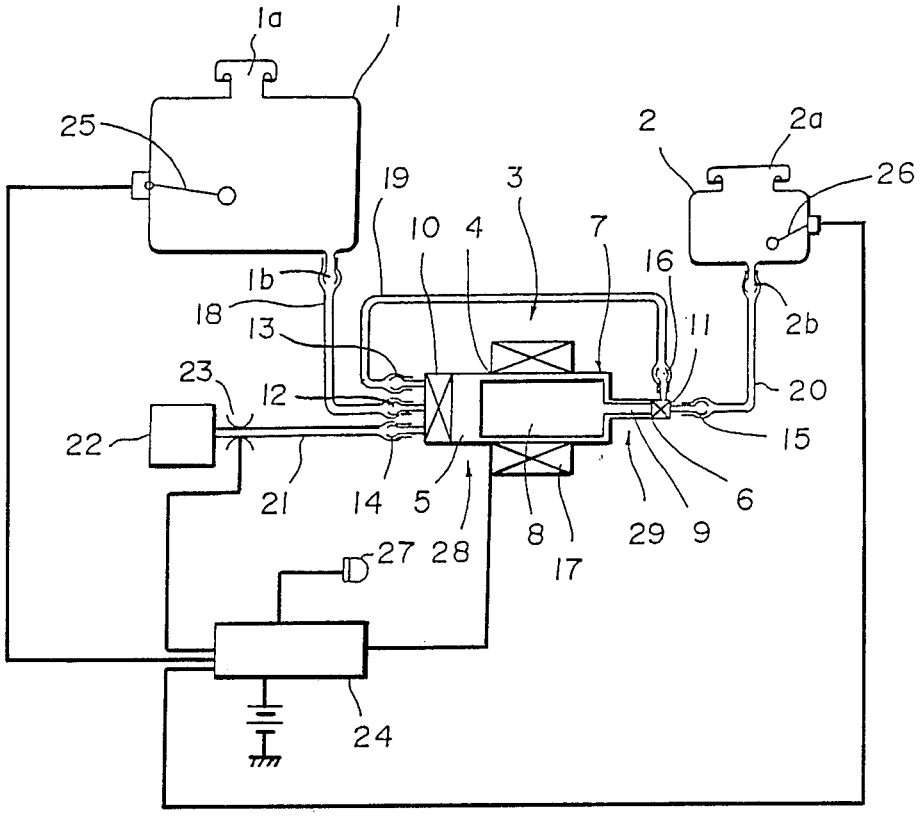
FIG. 1 is a schematic diagram of a first embodiment of the present invention.

Turning in detail to the drawings, FIG. 1 displays a fuel tank 1 which for containing gasoline, a lubricating oil tank 2 which for containing two-cycle engine oil and respective inlets 1*a* and 2*a* on the top and respective outlets 1*b* and 2*b* on the bottom of each tank.

An electromagnetic pump 3 is shown, containing a fuel pump cylinder 5 and an oil pump cylinder 6 which are concentrically mounted. The fuel pump cylinder 5 is of larger diameter than the oil pump cylinder 6. A plunger 7 is comprised of a fuel plunger 8 and an oil plunger 9. The fuel plunger 8 and oil plunger 9 slide within their respective cylinders 5 and 6.

The fuel pump cylinder 5 contains a check valve mechanism 10 at its end, while the oil pump cylinder 6 contains a check valve mechanism 11 at its end.

The check valve mechanism 10 is provided with two inlets 12 and 13 and an outlet 14. When the fuel plunger 8 recedes, the first and second inlets 12 and 13 are opened, while the outlet 14 is closed. Similarly, when the fuel plunger 8 advances, the inlets 12 and 13 are closed while the outlet 14 is opened.

The check valve mechanism 11 contains an inlet 15 and an outlet 16. When the oil plunger 9 recedes, the inlet 15 is opened while the outlet 16 is closed. Similarly, when the oil plunger 9 advances, the inlet 15 is closed while the outlet 16 is opened.

The pump body 4 is provided with a magnetic coil 17 which is energized and inactivated to move the plunger 7.

Thus, the fuel pump 28 includes the fuel pump cylinder 5, the fuel plunger 8, the check valve mechanism 10 and the magnetic coil 17; and the lubricating oil pump includes the oil pump cylinder 6, the oil plunger 9, the check valve mechanism 11 and the magnetic coil 17.

The first fuel pump inlet 12 is connected to the fuel tank outlet 1*b* via a pipe 18 and the second fuel pump inlet 13 is connected to the oil pump outlet 16 via a pipe 19. The oil pump inlet 15 is connected to the oil tank outlet 2*b* via a pipe 20. Thus, a lubricant passage is defined between the lubricant tank 2 and the source of fuel from the tank 1, including the pipe 20, the oil pump cylinder 6 and the pipe 19. The fuel pump outlet 14 is connected to an inlet of a carburetor 22 via a pipe 21. Thus, a fuel passage exists between the fuel tank 1 and the carburetor 22, including the pipe 18, the fuel pump cylinder 5 and the pipe 21. An outlet of the carburetor 22 is connected to an intake port of an internal combustion engine (not shown).

The pipe 21 connecting the outlet 14 and the inlet of the carburetor 22 is provided with a flow sensor 23 which is connected to an input of the control unit 24. An output of the control unit 24 is connected to the magnetic coil 17 of the fuel pump 3.

Both the fuel tank 1 and the oil tank 2 include detectors 25 and 26, respectively, such as flow switches for detecting the amounts of fuel and lubricating oil contained therein. These detectors are connected to other inputs of the control unit 24 and another output of the control unit 24 is connected to an alarm lamp 27 for signaling whenever the amount of either fuel or lubricating oil decreases below a predetermined level. The operation of this device proceeds as follows:

The control unit 24 receives a signal from the flow sensor 23 and supplies an instruction signal to the magnetic coil 17 of the pump 3, thereby energizing or inactivating the magnetic coil 17 in order to move the plunger 7 responsive to the output signal of the sensor 23. When the plunger 7 moves leftward in FIG. 1, the lubricating oil flows into the oil cylinder 6 from the oil tank 2 through the check valve 11. When the plunger 7 moves rightward, the lubricating oil is forced to flow from the outlet 16 to the second fuel pump inlet 13 through the check valve 10 via the pipe 19, finally entering the fuel pump cylinder 5, thus providing means for controlling fuel flow, oil flow and the mechanism for mixing fuel and oil for provision to the carburetor 22 responsive to fuel flow.

When the plunger 7 moves rightward, the fuel also flows from the fuel tank 1 into the fuel pump cylinder 5, via the pipe 18, through the first the inlet 12 and the check valve 10. Thus, rightward movement of the plunger 7 introduces lubricating oil and fuel into the fuel pump cylinder 5 which are fully stirred and mixed as a result of the fuel's flow velocity and turbulence. It will be appreciated, therefore, that in this embodiment the fuel pump cylinder 5 functions also as a mixing chamber.

The resulting mixed fuel has a fuel-oil mixing ratio which is determined by a ratio in volume of the fuel pump cylinder 5 to the oil pump cylinder 6. Because the stroke of plunger 7 is constant, the mixing ratio is eventually determined by the ratio in diameter of the fuel pump cylinder 5 to the oil pump cylinder 6.

In the pump 3, the leftward movement of the plunger 7 forces the mixed fuel to flow from the fuel pump cylinder 5 through the check valve 10, the outlet 14 and the pipe 21 into the carburetor 22, and finally into an internal combustion engine.

When the fuel or lubricating oil has run dry, the detectors 23, 25 and 26 send signals to the control box 24 which, in turn, sends a signal to the alarm lamp 27 and inactivates the magnetic coil 17 in order to stop the pump unit 3. This serves to prevent engine damage.

Figure 2:
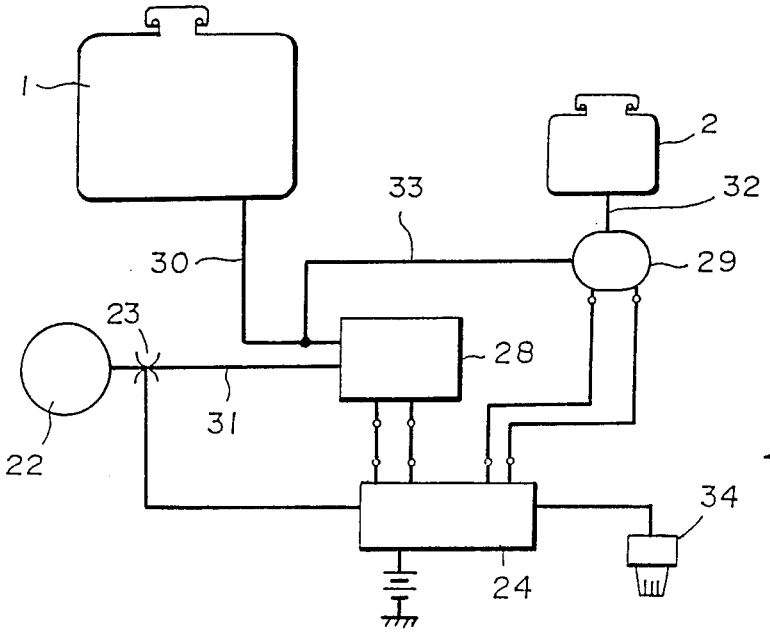
FIG. 2 is a schematic diagram of a second embodiment of the present invention.

Turning next to the embodiment of FIG. 2, identical reference numerals are employed where identical or equivalent components to those in FIG. 1 are illustrated. This embodiment is distinguished chiefly from that in FIG. 1 by the separation of the fuel pump 28 from the oil pump 29, the channeling of the oil pump output pipe 33 directly into the fuel pump input pipe 30 and the use of a mixing ratio control knob 34 connected to the control unit 24. Features having substantial similarity to the foregoing embodiment of FIG. 1 are not specifically discussed with reference to the embodiment of FIG. 2. Thus, the foregoing discussion is incorporated with reference to this second embodiment.

An inlet of the fuel pump 28 is connected to a fuel tank 1 via a pipe 30, and an outlet of fuel pump 28 is connected to an inlet of the carburetor 22 via a pipe 31. Thus, a fuel passage exists between the fuel tank 1 and the carburetor 22, including the pipe 30, the fuel pump 28 and the pipe 31. An inlet of the oil pump 29 is connected to the oil tank via a pipe 32, and an outlet of the oil pump 29 is connected via a pipe 33 to the pipe 30 connected to the inlet of the fuel pump 28. Thus, a lubricant passage is defined between the lubricant tank 2 and the source of fuel from the tank 1, including the pipe 32, the oil pump 29 and the pipe 33. The pipe 31 connected to the outlet of the fuel pump 28 is provided with a flow detector 23 which is connected to an input of the control box 24. Outputs of the control box are connected to each pump 28 and 29. The control unit 24 is provided with a mixing ratio control knob 34. The control unit 24 receives a signal from the flow detector 23 and supplies a control signal to each of the pumps 28 and 29, thus providing means for controlling fuel flow, oil flow and the resulting mixture to the carburetor 22 responsive to fuel flow.

The lubricating oil discharged from the oil pump 29 is supplied via the pipe 33 into the pipe 30 connected to the inlet of the fuel pump. The oil is mixed with the fuel at this point.

By adjusting the mixing ratio control knob 34, the control unit 24 can be operated so that a ratio in operating time of the oil pump 29 to the fuel pump 28 may be adjusted to control the mixing ratio of the mixed fuel. When fuel has run out, the flow detector 23 causes the control unit 24 to send a signal to the fuel pump 28 and oil pump 29 to stop them.

Figure 3:
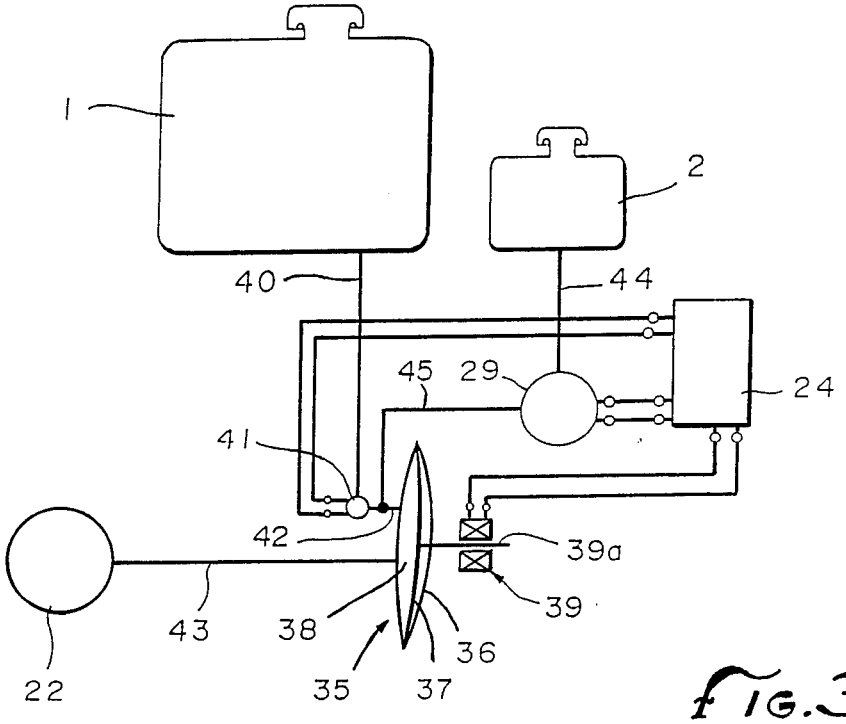
FIG. 3 is a schematic diagram of a third embodiment of the present invention.

Turning now to the embodiment in FIG. 3, identical reference numerals are employed where identical or equivalent components to those in FIGS. 1 and 2 are illustrated. This embodiment comprises a mixing-and-measurement device 35 in a fuel path for carrying out the flow measurement of the mixed fuel simultaneously with the mixing of fuel and lubricating oil. This mixing-and-measurement device 35 is a volume changeable-type chamber comprising a container body 36 and a diaphragm 37 mounted in the body 36 for defining a measuring chamber 38. The diaphragm 37 is connected via a moving rod 39*a* to a measurement sensor 39 which acts upon displacement of the rod 39*a*.

Unlike embodiments in FIGS. 1 and 2, this system contains no fuel pump.

A pipe 40 connects a fuel tank 1 and an inlet to a control valve 41. An outlet from the control valve 41 is connected via a pipe 42 to the measuring chamber 38 of the mixing-and-measurement device 35. The measuring chamber 38 is connected to an inlet of a carburetor 22 via a pipe 43. Thus, a fuel passage exists between the fuel tank 1 and the carburetor 22, including the pipe 40, the control valve 41, the pipe 42, the measuring chamber 38 and the pipe 43. A lubricating oil pump 29 has an inlet connected to a lubricating oil tank 2 via a pipe 44 and an outlet connected to the pipe 42 via a pipe 45. Thus, a lubricant passage is defined between the lubricant tank 2 and the source of fuel from the tank 1, including the pipe 44, the pump 29 and the pipe 45.

The measurement sensor 39 is connected to an input of the control unit 24, and outputs of the control box 35 are connected to a driving means of the oil pump 29 and an operating means of the control valve 41, thus providing means for controlling fuel flow, oil flow and the resulting mixture to the carburetor 22 responsive to fuel flow.

Accordingly, a measurement signal is sent from the measurement sensor 39 to the control box 24 which in turn sends control signals to the driving means of the lubricating oil pump 29 and to the operating means of the control valve 41. Thus, the oil pump 29 is operated and simultaneously the control valve 41 is controlled to have the desired opening ratio, so that the measuring chamber 38 of the mixing-and-measurement device 35 is filled with fuel having a flow controlled by the control valve 41 and the oil in an amount satisfying the desired mixing ratio.

It may further prove practicable to change the mixing-and-measurement device 35 into a diaphragm-type fuel pump.

When the fuel has run out, the measurement sensor 39 causes the control unit 24 to signal the oil pump 29 to stop and close the control valve 41.

In this embodiment, lubricating oil is introduced into the fuel just upstream of the mixing-and-measurement device. The two fluids are mixed as a result of the fuel's flow velocity and turbulence.

Figure 4:
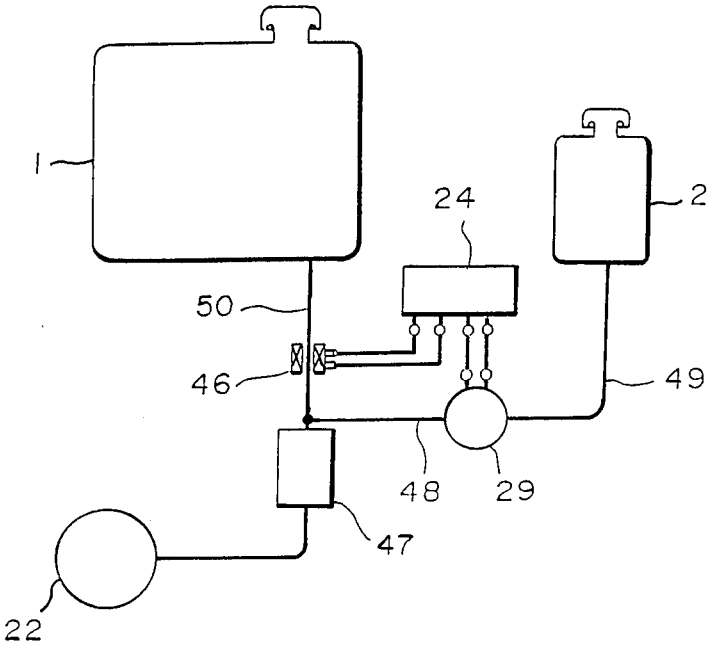
FIG. 4 is a schematic diagram of a fourth embodiment of the present invention.

Turning finally to the embodiment in FIG. 4, identical reference numerals are employed for components similar to those in FIGS. 1, 2 and 3. This embodiment illustrates a fuel flow sensor 46 provided on a fuel path 50 between a fuel tank 1 and a carburetor 22. A fuel chamber 47 is located between the sensor 46 and the carburetor 22. The fuel flow sensor 46 is connected to an input of the control unit 24, and an output of the control unit 24 is connected to a driving means of an oil pump 29. The oil pump 29 has an inlet connected to the oil tank 2 via a pipe 49 and an outlet connected to the fuel path 50 via a pipe 48 just upstream of an inlet of the fuel chamber 47 to define a lubricant passage.

The mixture flowing into the mixture chamber 47 has a flow rate calculated to fill between one quarter and three quarters of the fuel chamber 47.

In operation, the fuel flow sensor 46 sends a signal based upon flow measurement to the control unit 24 which in turn sends a control signal to the driving means of the oil pump 29 in order to operate it, whereby the lubricating oil is supplied to the mixture chamber 47 together with the mixture in an amount that satisfies the required mixing ratio. The fuel and the lubricating oil are mixed in the mixture chamber 47 to form a mixed mixture which is supplied to the carburetor 22. When the fuel runs out, the flow sensor 46 signals the control unit 24 to, in turn, signal the stoppage of the oil pump 29.

Thus, improved fuel mixing devices are here presented. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A system for supplying mixed fuel and oil to an internal combustion engine having a fuel tank, an oil tank, and a carburetor, comprising:
   - a mixture supply line to said carburetor;
   - a fuel and oil mixing chamber in said mixture supply line upstream of said carburetor;
   - means for supplying fuel from said fuel tank to said mixing chamber;
   - means for supplying oil from said oil tank to said mixing chamber;
   - means for sensing the rate of flow of mixture flowing in said mixture supply line; and
   - control means for controlling said fuel supply means and said oil supply means in response to the output of said sensing means.

2. The system according to claim 1 including a fuel pump and an oil pump controlled by said control means, said fuel pump including a piston operable in a cylinder, means for supplying fuel and oil to said cylinder on the intake stroke of said piston and for supplying mixed fuel and oil to said mixture supply line on the output stroke thereof.

3. The system according to claim 2 in which said fuel pump and said oil pump each contain pistons operated in cylinders, the oil discharged from said oil pump cylinder being supplied to said fuel pump cylinder, and the dimensional ratio of the diameters of said cylinders corresponding to the ratio of mixed fuel and oil supplied to said mixture supply line.

4. The system according to claim 3 in which said fuel pump piston and said oil pump piston operate in tandem.

5. The system according to claim 2 in which oil discharged from said oil pump to said fuel pump cylinder is mixed upstream of said fuel pump cylinder.

6. The system according to claim 1 in which said mixing chamber includes a diaphragm movable in said chamber; and means for controlling said fuel supply means and said oil supply means in response to movement of said diaphragm.

* * * * *